US006709177B1

(12) United States Patent
Sugimura

(10) Patent No.: US 6,709,177 B1
(45) Date of Patent: Mar. 23, 2004

(54) PAPER FEEDING APPARATUS AND IMAGE FORMING APPARATUS

(75) Inventor: Naoto Sugimura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 123 days.

(21) Appl. No.: 09/722,038

(22) Filed: Nov. 27, 2000

(30) Foreign Application Priority Data

Apr. 6, 2000 (JP) ..... P.2000-104559

(51) Int. Cl.[7] ..... B41J 11/50

(52) U.S. Cl. ..... 400/605; 400/607; 400/624; 400/693; 271/9.11; 271/9.13

(58) Field of Search ..... 271/10.09, 10.11, 271/10.12, 9.11, 9.13, 9.01, 242; 399/391; 400/605, 607, 624, 625, 691, 693

(56) References Cited

U.S. PATENT DOCUMENTS

| | | | | |
|---|---|---|---|---|
| 4,872,659 A | | 10/1989 | Kato et al. | 271/9.01 |
| 5,116,034 A | * | 5/1992 | Trask et al. | 271/121 |
| 5,184,734 A | * | 2/1993 | Yamaguchi | 209/657 |
| 5,391,009 A | * | 2/1995 | Stodder | 101/232 |
| 5,405,128 A | * | 4/1995 | Fujiwara et al. | 271/164 |
| 6,105,953 A | * | 8/2000 | Komuro | 271/186 |
| 6,152,561 A | * | 11/2000 | Watanabe | 271/9.09 |

FOREIGN PATENT DOCUMENTS

| | | |
|---|---|---|
| JP | 59-190129 | 10/1984 |
| JP | 4-247469 | 9/1992 |
| JP | 7-40169 | 5/1995 |

* cited by examiner

*Primary Examiner*—Andrew H. Hirshfield
*Assistant Examiner*—Kevin D. Williams
(74) *Attorney, Agent, or Firm*—Morgan, Lewis & Bockius LLP

(57) ABSTRACT

Two paper trays 11, 12 are disposed in such a manner that they are superimposed on top of each other in the vertical direction, a first paper feed roller 13 for feeding out paper from the upper-side paper tray 11 is disposed backwardly of and obliquely upwardly of a second paper feed roller 14 with respect to a direction in which the paper is fed out, and the upper-side paper tray 11 is disposed backwardly of and adjacently to the second paper feed roller 14. The sheets of paper fed out from the upper- and lower-side paper trays are delivered along the upper or lower surface of the second paper feed roller 14 and a are then fed into a common registration roller 10 without providing a delivery roller on the way. A holder 18 for supporting a handling member 16 to be contacted with the second paper feed roller 14 is supported by the paper tray 12 and can be retreated downwardly when pulling out the paper tray 12.

18 Claims, 9 Drawing Sheets

PAPER FEEDING APPARATUS AND IMAGE FORMING APPARATUS

BACKGROUND OF THE INVENTION

1. Field of the Invention

The present invention relates to an image forming apparatus for recording images on a sheet-shaped recording medium such as paper cut to a given size, and a paper feeding apparatus for piling up image recording sheets of paper on one another to store the image recording sheets of paper therein and also for feeding out the image recording sheets of paper one by one therefrom.

2. Description of the Related Art

An image forming apparatus such as a copying machine, a printer and a facsimile includes various types such as an electrophotographic type, an ink jet type and a heat transfer type; and, in most of them, images such as letters and pictures are formed on paper which is cut to a given size.

For example, in the ink jet type and heat transfer type, the images are formed on the paper in accordance with digital signals. Also, in the electrophotographic type and electrostatic recording type, toners are applied onto electrostatic latent images carried on an image carrier element to thereby form toner images there, and the toner images are then transferred to and fixed on the paper.

The sheets of paper, on which images are to be formed, are generally piled up on top of each other and stored in a paper feeding apparatus disposed within the image forming apparatus and the thus stored sheets of paper are then supplied sequentially one by one from the paper feeding apparatus.

The sheets of paper to be stored within the paper feeding apparatus must be replenished properly. In order to be able to facilitate this paper replenishment, there is used a paper tray which can be mounted onto and removed from the main body of the image forming apparatus; that is, the sheets of paper are replenished into the paper tray and stored in the paper tray. In some cases, only one paper tray is disposed for one image forming apparatus; and, in most cases, two or more cassettes (paper trays) are used in combination in order to be able to select sheets of paper of different sizes and apply images onto the selected paper. And, in some other cases, in combination with the two or more paper trays, there is disposed a hand-held tray which is convenient when various sheets of paper having different sizes are used arbitrarily.

A mechanism, which is used to take out the sheets of paper one by one from the paper tray or hand-held tray and feed them one by one to a position where images can be given, is generally structured as shown in FIGS. 8A and 8B.

Specifically, FIG. 8A shows a structure of a type in which a function to feed out the sheets of paper and a function to prevent two or more sheets of paper from being fed together in a superimposed manner are divided from each other; and, this type of structure comprises a paper feed roller 101 which can be contacted with the upper surface of paper 104 stored within a paper tray and can be rotated to thereby feed out the top-layer sheet of paper from the paper tray, a handling roller 102 for delivering the thus fed-out paper while preventing two or more sheets of paper from being fed together in a superimposed manner, and a handling member (pad) 103 which is formed of material showing large friction and can be contacted with the handling roller 102 to thereby separate superimposedly-fed sheets of paper from each other.

In this mechanism, the paper 104, which has been fed out from the paper tray by the paper feed roller 101, is passed through the contact position between the handling roller 102 and handling member 103 and is then delivered to an image applying position. And, in case where two or more sheets of paper are taken out from the paper tray while they are superimposed on top of each other, at the time when the lower surface of the paper is contacted with the handling member 103, the friction between the paper 104 and handling member 103 becomes larger than the friction between the superimposed sheets of paper, so that the sheet of paper on the lower side is separated from the sheet of paper on the upper side and thus only the sheet of paper on the upper side is delivered to the image applying position.

Now, FIG. 8B shows a structure of another type in which a paper feed roller has a function to feed out the sheets of paper from the paper tray and a function to prevent two or more sheets of paper from being fed together in a superimposed manner. In this type of structure, a paper feed roller 111 is contacted with the upper surface of paper 113 stored in a paper tray and, at the same time, a handling member 112 is contacted with the rotation-direction downstream side of the paper feed roller In this type of mechanism, similarly to the above type of mechanism, the paper can be fed out from the paper tray and, while the handling member 112 prevents two or more sheets of paper from being fed together in a superimposed manner, only a sheet of paper can be delivered to the image applying position. In this type, since the contact portion of the paper 113 and the contact portion of the handling member 112 are set on the peripheral surface of the paper feed roller 111, the diameter of the paper feed roller 111 must be set rather large. In spite of this, however, there can be obtained an advantage that the paper feed mechanism can be simplified in structure and thus the manufacturing cost thereof can be reduced.

On the other hand, the paper tray is classified into two types according to the removing directions thereof, while the two types of paper trays are selectively used depending on the types of the paper feed mechanisms. That is, when the paper tray is set, the paper feed mechanism is situated in the vicinity of the end portion of the paper tray and feeds out the sheets of paper substantially in the horizontal direction from the end portion of the paper tray. In this case, there are two types of paper trays: specifically, in one type, the paper tray can be removed from an image forming apparatus by pulling the paper tray in the same direction as a direction in which the paper is fed out from the paper tray; and, in the other type, the paper tray can be removed by pulling the same in the opposite direction to the above-mentioned paper feed-out direction.

An image forming apparatus of a type that a paper tray is removed in the same direction as the paper feed-out direction is disclosed in, for example, JP-A-4-247469 and JP-B-7-40169.

Also, an image forming apparatus of a type that a paper tray is removed in the opposite direction to the paper feed-out direction has such a structure as shown in FIG. 9.

In this apparatus, paper trays 121, 122 can be mounted into and removed from the apparatus through the front surface thereof; and, paper fed out from the reapportion of the apparatus is passed through a delivery passage 123 and is then delivered to a portion 124 where an image is transferred.

As a mechanism for operating a handling member when removing a paper tray from the main body of the image forming apparatus, there are two different types. That is, in one type of mechanism, the handling member is supported on the apparatus main body side and thus it is separated from the paper tray; and, even in case where the paper tray is pulled out from the apparatus main body, the handling member is still left within the apparatus. On the other hand, in the other type of mechanism, the handling member is mounted on the paper tray and thus the handling member is taken out from the apparatus main body simultaneously when the paper tray is pulled out.

Also, as a mechanism for bringing sheets of paper piled up within a form tray into contact with a paper feed roller, there are available various types.

The sheets of paper to be stored within the paper tray varies in quantity as they are replenished or consumed but the upper surface of the top-layer sheet of paper must be always contacted with the paper feed roller. In view of this, there are employed many mechanisms structured such that the paper feed roller or the piled-up sheets of paper can be energized by springs or other similar means. Of these mechanisms, a mechanism, in which the sheets of paper can be contacted with the paper feed roller in linking with the mounting and removing operation of the paper tray, is simplified in structure to thereby be able to provide many advantages. Referring here to the specific structure of this mechanism, within the paper tray, there is disposed a paper carrier plate which can be moved up and down and, in linking with the paper tray mounting operation, the paper carrier plate is moved up and guided to thereby be able to bring the upper surface of the paper into contact with the paper feed roller.

However, in the above-mentioned conventional image forming apparatus or paper feeding apparatus, there are still found the following several drawbacks that are tone improved or solved.

That is, in the structure comprising two or more paper trays each formed as a cassette that can be mounted into and removed from the apparatus main body, or in the structure comprising one or more mountable and removable paper tray(s) and a hand-held paper tray for placing sheets of paper onto the paper placing portion of the apparatus main body by hand, as in the apparatus shown in FIG. 9, generally, the paper trays and hand-held paper tray are disposed respectively on the upper and lower sides in the vertical direction. In the apparatus in which the direction to feed out the paper from the paper trays is the same as the direction to pull out the cassettes from the apparatus main body, there may be employed a structure in which the hand-held paper tray is not arranged above or below the paper trays in the vertical direction. On the other hand, in the apparatus in which the paper feed-out direction is opposite to the paper tray pull-out direction, as shown in FIG. 9, from the viewpoint of the arrangement of a paper delivery passage as well as the stable installation of the paper trays, it is most reasonable that the paper trays and hand-held paper tray are respectively arranged in the vertical direction.

However, in the thus structured apparatus, there arises a problem that the vertically piled-up arrangement of the sheets of paper increases the height of the apparatus. Especially, in case where a single paper feed roller has not only a function to feed out the paper from the paper trays but also a function to prevent two or more sheets of paper from being fed together in a superimposed manner, the diameter of the paper feed roller becomes larger, which worsens the above problem to a great extent.

On the other hand, as in an apparatus which is disclosed in JP-A-59-190129, there is also known a structure in which an upper-stage paper tray is set at a position with drawn backwardly of a lower-stage paper tray. However, in this apparatus, the paper feed starting positions in the respective paper trays are distant from each other, whereby the delivery passages of the sheets of paper fed out from these paper trays are complicated in structure. This causes an obstacle to reduction in the manufacturing cost of the apparatus.

Also, as a second problem, in the structure that the paper tray is pulled out from the apparatus may body in the opposite direction to the paper feed-out direction, in case where the handling member is mounted on the paper tray, the paper feed roller supported on the apparatus main body interferes with the handling member, which makes it impossible to pull out the paper tray. That is, in FIG. 8B, when trying to move the handling member 112 mounted on the paper tray together with the paper tray in a direction of an arrow mark C, the paper feed roller 111 provides an obstacle to such movement, thereby making it impossible to pull out the paper tray.

On the other hand, in case where the handling member is supported on the apparatus main body side, there can be avoided the obstacle to the paper tray pull-out operation but, when the paper tray is pulled out, in case where one or more sheets of paper having reached the handling member and prevented against superimposedly simultaneous feeding are present on the handling member, such sheet(s) of paper are left within the apparatus main body. Also, in the Japanese Patent No. 2584849, there is disclosed a mechanism which can retreat the handling member from the paper feed roller at the same time when the paper tray is pulled out. However, such mechanism is complicated, which results in the increased manufacturing cost of the apparatus.

As a third problem, in case where two or more paper trays are arranged in the vertical direction and the distance between these paper trays is narrowed so as to minimize the height of the apparatus, it is difficult to provide a mechanism which is used to raise the paper carrier plate such that the sheets of paper stored in the paper trays can be contacted with the paper feed roller. In other words, the limited vertical dimension makes it impossible to provide a paper tray storing portion on the bottom portion of the apparatus; that is, the paper tray storing portion must be provided on the side portion of the apparatus. However, in this case, it requires a large force to raise a large number of piled-up sheets of paper and energize the paper feed roller and, therefore, the paper carrier plate must be guided by a member having sufficient strength. Also, it is necessary to employ a structure in which members mounted on the apparatus main body side can be prevented from interfering with the paper tray. This requires a new improvement in a mechanism for raising the paper carrier plate.

SUMMARY OF THE INVENTION

The present invention aims at eliminating the above-mentioned drawbacks found in the conventional image forming apparatus and paper feeding apparatus. Accordingly, it is an object of the invention to minimize the area to be occupied by a paper feeding apparatus and simplify the structures of mountable and removable paper trays and their attendant components. And, in more particular, it is an object of the invention to provide an image forming apparatus or a paper feeding apparatus including two or more paper trays in which the height of the apparatus can be minimized and the paper delivery function of the apparatus can be simplified to thereby reduce the manufacturing cost of the apparatus. And, it is another object of the invention to provide, in the above image forming apparatus or paper feeding apparatus, a structure for pulling out the paper trays in the opposite direction to the feed-out direction of sheets of paper stored in the paper trays, in which a handling member to be contacted with a paper feed roller can be prevented from interfering with the paper feed roller when the paper trays are pulled out. Further, it is still another object of the invention to provide, in the above image forming apparatus or paper feeding apparatus, a simple mechanism which is capable of energizing the sheets of paper stored in the paper trays to thereby bring the same into close contact with the paper feed roller.

In attaining the above objects, according to the invention, there is provided a paper feeding apparatus, comprising: at least two paper trays disposed respectively on the upper and lower sides in the vertical direction; a first paper feed roller contactable with sheets of paper piled up and stored in the upper-side paper tray of the vertically disposed paper trays to thereby feed out the sheets of paper one by one therefrom; a second paper feed roller contactable with sheets of paper piled up and stored in the lower-side paper tray of the vertically disposed paper trays to thereby feed out the sheets of paper one by one therefrom, wherein the first paper feed roller is disposed backwardly of and obliquely upwardly of the second paper feed roller with respect to a direction to feed out the sheets of paper.

The above-mentioned term "a direction to feed out the sheets of paper (paper feed-out direction)" means simply a direction on a horizontal line and thus, even in case where the sheets of paper are delivered obliquely upwardly immediately after they are fed out from the paper tray, the position of the second paper feed roller is not to be changed.

By disposing the first and second paper feed rollers in the above-mentioned manner, not only the two paper feed rollers can be respectively contacted with the end portions of the upper surfaces of the sheets of paper stored in the paper trays to thereby be able to feed out the sheets of paper from the paper trays, but also the two paper feed rollers can be positioned nearer to each other than the conventional paper feeding apparatus. And, the upper-side paper tray is positioned backwardly of the second paper feed roller and also can be arranged adjacently to the lower-side paper tray when compared with the conventional paper feeding apparatus. Therefore, the height of a space to be occupied by the paper trays and paper feed rollers can be reduced.

Also, sheets of paper, which are fed out by the thus arranged two paper feed rollers, can be fed into the same paper delivery roller. That is, since the two paper feed rollers are disposed near to each other and thus the positions where the sheets of paper are fed out are made nearer to each other, two paper delivery passages from the two paper feed rollers can be made to meet each other at a position near to the two paper feed rollers; and, therefore, the sheets of paper can be fed directly into the same paper delivery roller without providing delivery rollers separately in the paper delivery passages extending from the paper trays to the meeting position. With use of this structure, the paper delivery passage can be simplified in structure and thus the manufacturing cost of the paper feeding apparatus can be reduced.

On the other hand, the upper-side paper tray is disposed backwardly of and adjacently to the second paper feed roller with respect to the paper feed-out direction, and the first paper feed roller is disposed backwardly of and obliquely upwardly of the second paper feed roller, whereby the sheets of paper fed out by the first paper feed roller are allowed to pass through between the first and second paper feed rollers.

In case where the paper trays and paper feed rollers are arranged in this manner, the second paper feed roller and the upper-side paper tray can be arranged side by side at the same height position in the horizontal direction, thereby being able to reduce the height of the range to be occupied by the paper trays and paper feed rollers. And, the sheets of paper fed out from the upper- and lower-side paper trays can be delivered along the lower and upper surfaces of the second paper feed roller and the two delivery passages, can be made to meet each other in front of the second paper feed roller. Therefore, the delivery passage of the sheets of paper can be simplified in structure.

Also, when the first paper feed roller is disposed backwardly of and obliquely upwardly of the second paper feed roller with respect to the paper feed-out direction, preferably, these two paper feed rollers may be set at mutually adjacent positions and, where their radii are respectively expressed as R1 and R2, the centers of the two paper feed rollers may be spaced from each other by a distance equal to or more than R1 or R2 and equal to or less than (R1+R2) in the horizontal direction, or by a distance equal to or more than R1 or R2 and equal to or less than (R1+R2) in the vertical direction.

With use of this arrangement, the area to be occupied by the paper trays and paper feed rollers can be minimized in the horizontal direction and/or in the vertical direction. And, the sizes and positions of the paper trays can be set in such a manner that the end portion of the upper-side paper tray can be stored in an area the three sides of which are enclosed by the lower-side paper tray, second paper feed roller and first paper feed roller disposed obliquely upwardly of the second paper feed roller; that is, the space can be used reasonably and thus the area to be occupied by the paper feeding apparatus can be reduced.

On the other hand, the first paper feed roller is disposed obliquely upwardly of and adjacently to the second paper feed roller with respect to the paper feed-out direction and the height of the upper-side paper tray is set smaller than the diameter of the second paper feed roller, whereby the upper-side paper tray can be disposed backwardly of the second paper feed roller such that they are situated side by side in the horizontal direction. This can minimize the area to be occupied by the paper feed rollers and paper trays.

In the above-structured paper feeding apparatus or image forming apparatus, the first or second paper feed roller may be formed as a semicircular-shaped roller with the peripheral surface thereof cut away in part, and the first or second paper feed roller may be structured such that, while it is rotated once to thereby allow the other remaining arc-shaped portion thereof than the partially-cutaway portion to feed the sheets of paper, it feeds the sheets of paper into the common form delivery roller capable of delivering both of the sheets of paper to be fed out from the first and second paper feed rollers.

The above-mentioned semicircular-shaped roller is able to deliver the sheets of paper intermittently with a simple structure, while the deliverable length of paper is limited to the remaining peripheral length except for the cut-away portion. However, by arranging the paper feed rollers and paper trays in the above-mentioned manner, even in case where the diameters of the paper feed rollers are set large, the area to be occupied by them can be reduced. And, by setting large the diameters of the paper feed rollers, within the range that the paper feed rollers can deliver the sheets of paper, there can be disposed a common paper delivery roller which is capable of delivering the sheets of paper respectively fed out from the two paper trays, thereby being able to simplify a paper delivery mechanism.

In the above-mentioned paper feeding apparatus or in the above-mentioned image forming apparatus using such paper feeding apparatus, the paper tray used may be formed in a cassette which can be mounted into and removed from the apparatus, or may be formed as a hand-held paper tray which allows paper having an arbitrary size to be easily inserted from externally of the apparatus.

Also, with respect to the paper tray formed as a mountable and removable cassette, there can be employed the following structure:

That is, a paper feeding apparatus comprises: a paper tray in which sheets of paper can be piled up and stored; a paper feed roller contactable with the upper surfaces of the sheets of paper stored in the form tray to thereby feed out the forms one by one from the paper tray; and, a handling member, on the paper-feed-out-direction downstream side of a position at which the paper feed roller can be contacted with the sheets of paper within the paper tray, contactable with the peripheral surface of the paper feed roller to thereby prevent two or more sheets of paper from being delivered together in a superimposed manner, wherein the paper tray can be removed from the main body of the paper feeding apparatus supporting the paper feed roller by pulling out the same in the opposite direction to the paper feed-out direction. And, the present handling member is mounted on the paper tray and can be made to retreat from the surface of the paper feed roller when the paper tray is pulled out from the paper feeding apparatus main body.

For a mechanism which is used to retreat the handling member, for example, there can be employed the following structure: that is, the handling member is disposed on the other end side of a holder having one end rotatably mounted on the form tray, and the position of the holder can be restricted such that the handling member can be contacted with the paper feed roller or the handling member can be made to retreat from the paper feed roller as the paper tray is mounted or removed.

With use of this structure, when the paper tray is pulled out from the paper feeding apparatus, the handling member is retreated from the paper feed roller to thereby be able to avoid its interference with the paper feed roller. Also, the mechanism for retreating the handling member can be simplified in structure.

In case where the paper tray is structured such that it can be removed by pulling out the same in the opposite direction to the paper feed-out direction, for a mechanism for bringing the sheets of paper stored in the paper tray into contact with the paper feed roller, there can be employed the following structure:

That is, a paper feeding apparatus comprises: a paper tray in which sheets of paper are piled up and stored; and, a paper feed roller contactable with the upper surfaces of the sheets of paper stored in the paper tray to feed out the sheets of paper one by one from the paper tray, wherein the paper tray can be removed from the main body of the paper feeding apparatus supporting the paper feed roller by pulling out the paper tray in the opposite direction to the paper feed-out direction; the paper tray includes a paper carrier plate disposed on the bottom portion thereof, and a pull-up member connected to the paper carrier plate for pulling up the paper carrier plate to a position where sheets of paper on the paper carrier plate can be contacted with the paper feed roller; and, on the main body of the paper feeding apparatus into which the present paper tray can be removably mounted, there is further mounted a guide member engageable with the pull-up member to thereby guide the pull-up member upwardly in linking with the inserting or mounting operation of the paper tray.

And, the guide member includes two guide surfaces, while the two engagement portions of the pull-up member can be engaged with the present two guide surfaces sequentially and the pull-up member can be thereby pulled up in two stages.

According to this structure, when the paper tray is inserted into the apparatus main body, the paper carrier plate disposed on the bottom portion of the paper tray is pulled up to thereby be able to bring the upper surface of the paper stored in the paper tray into contact with the paper feed roller. The sheets of paper piled up on the paper carrier plate vary in quantity according to replenishment or consumption thereof. However, the pull-up member is guided by the two guide surfaces of the guide member and is thereby operated in a large range so that the sheets of paper can be properly contacted with the paper feed roller regardless of the quantity of the sheets of paper to be stored. Also, as a pull-up member, there can be disposed a member having sufficient strength in a narrow space and thus, even in case where a large number of sheets of paper are stored in the paper tray and the weight of the sheets of paper is large, the pull-up member is able to operate the paper carrier plate.

By the way, the mechanism for retreating the handling member from the paper feed roller and the mechanism for bringing the sheets of paper on the paper carrier plate into contact with the paper feed roller are not limited to the paper feeding apparatus or image forming apparatus including two or more paper feed rollers, but these mechanisms can also be applied to an apparatus including one paper tray and one paper feed roller as well as to other various types of apparatus.

DETAILED DESCRIPTION OF THE PRESENT INVENTION

Now, description will be given below of several preferred embodiments according to the invention with reference to the accompanying drawings.

Figure 1:
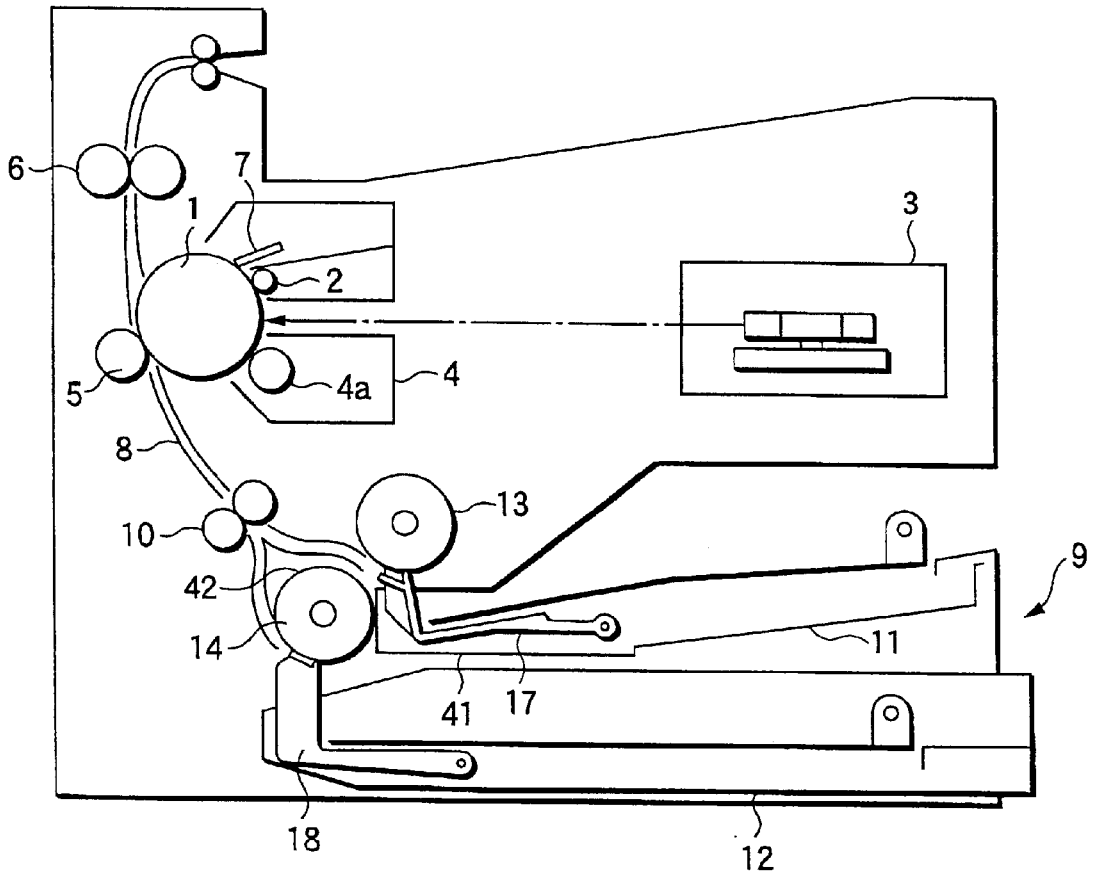
FIG. 1 is a schematic structure view of an image forming apparatus according to an embodiment of the invention.

FIG. 1 is a schematic structure view of an image recording (forming) apparatus which is an embodiment according to the invention.

This image recording apparatus comprises an image carrier element 1 on the surface of which, after charged uniformly, electrostatic latent images can be formed by radiating image light, a charging device 2 for charging the surface of the image carrier element 1 uniformly, an image writing device 3 for radiating the image light onto the image carrier element 1 in accordance with image data to thereby form latent images on the surface of the image carrier element 1 due to differences between electrostatic potentials, a developing device 4 for selectively transferring toners to the above-mentioned latent images to thereby visualize the same, a transfer device 5 for transferring the toner images on the image carrier element surface to recording paper supplied along a paper delivery passage 8, a fixing device 6 for heating and pressing the toner images on the recording paper to thereby melt and fix the same, and a cleaning device 7 for cleaning toners remaining on the image carrier element 1 after the toner images are transferred from the image carrier element 1.

Also, the image recording apparatus further comprises, in the lower portion thereof, a paper feeding apparatus 9 for storing recording sheets of paper therein and feeding out the same therefrom one by one, and a register roller 10 for delivering the sheets of paper fed out from the paper feeding apparatus 9 to the transfer positions of the toner images at a given timing.

The image carrier element 1 includes a photosensitive material layer on the surface thereof and, due to exposure after it is charged uniformly, the potential of the exposure portion of the image carrier element 1 is attenuated.

The charging device 2 is a roller-shaped member to be contacted with the image carrier element land, due to application of a voltage between them, there is produced discharge within a minute gap in the vicinity of the contact portion between the device 2 and element 1, thereby charging the surface of the image carrier element 1 almost uniformly.

As a charging device, besides the above-mentioned charging device 2, there can also be used a device which applies a high voltage to an electrode wire to thereby charge the image carrier element through corona discharge.

The image writing device 3 is a device which allows blinking laser to scan the peripheral surface of the image carrier element 1, thereby forming electrostatic latent images based on image data on the peripheral surface of the image carrier element 1. By the way, as an image writing device, light emitting elements such as LEDs may be arranged and they may be made to blink based on the image data.

The developing device 4 includes a cylindrical-shaped developing roller 4*a* disposed adjacently to the image carrier element 1 so as to be opposed to the same; and, a developing bias voltage is to be applied between the developing roller 4*a* and image carrier element 1. Due to this, between the developing roller 4*a* and image carrier element 1, there is formed a developing bias electric field, and toners having charge are transferred to the exposure portion formed on the image carrier element 1 to thereby form visible images.

The transfer device 5 is a roller-shaped member which is disposed so as to be opposed to the image carrier element 1; and, the transfer device 5 forms a transfer electric field between the image carrier element 1 and itself to thereby transfer the toner images onto the recording paper that is passing through the transfer device 5.

Figure 2:
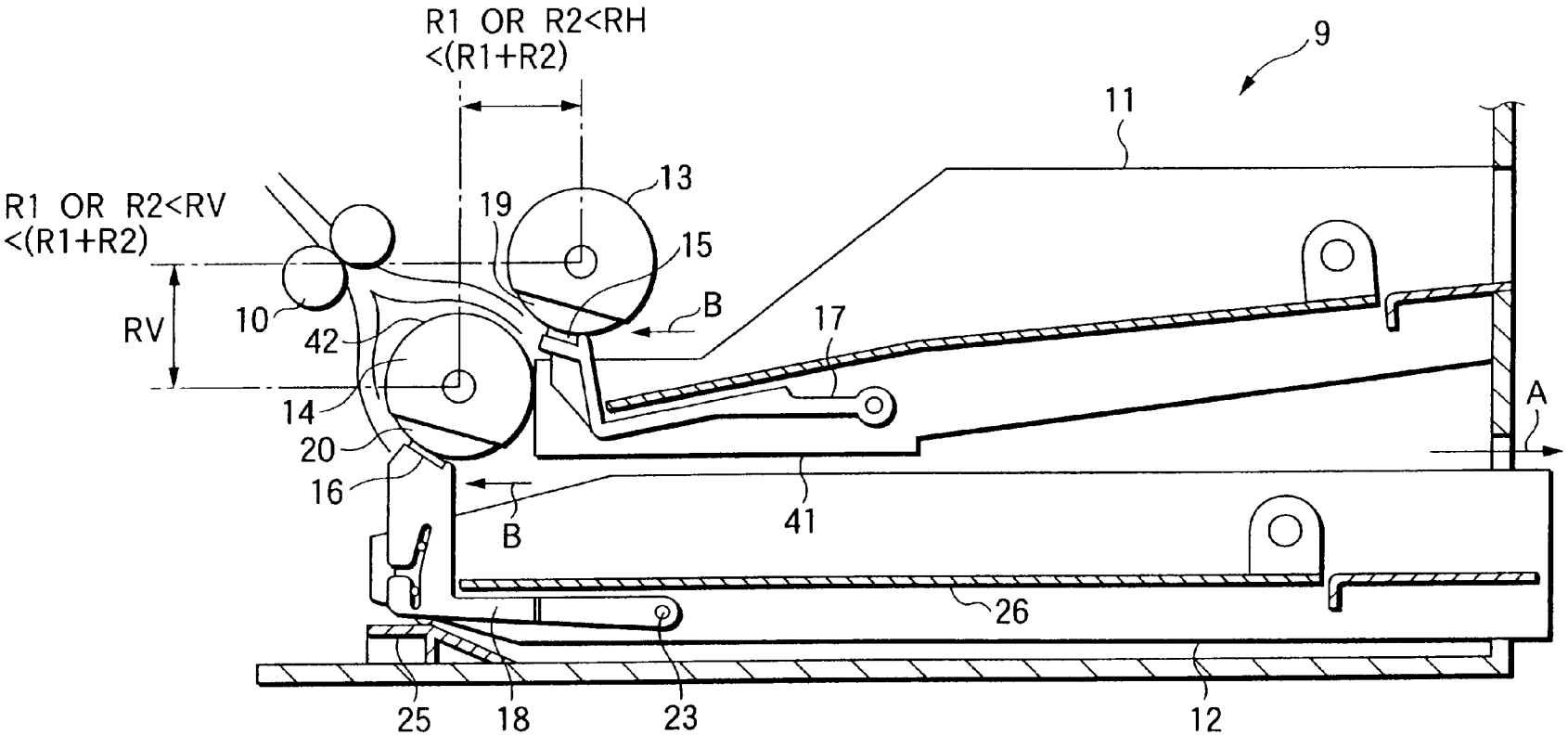
FIG. 2 is a schematic structure view of a paper feeding apparatus used in the image forming apparatus shown in FIG. 1.

The paper feeding apparatus 9, as shown in FIG. 2, comprises two form trays 11, 12 disposed respectively on the upper and lower sides in the vertical direction, first and second paper feed rollers 13, 14 for feeding out the sheets of paper from the upper or lower form tray, two handling members 15, 16 which can be respectively pressed against these paper feed rollers, and two holders 17, 18 respectively rotatably mounted on the paper trays 11, 12 to support the handling members 15, 16.

Of the two paper trays, the paper tray 12 arranged on the lower side is formed as a cassette which can be mounted into and removed from the main body of the image forming apparatus, while the form tray 12 can be pulled out in the opposite direction (that is, a direction of an arrow mark A shown in FIG. 2) to a direction in which the paper is fed out. Also, the upper side paper tray 11 is formed as a hand-held tray, whereas the paper tray 11 is structured such that, in use, paper having an arbitrary size can be easily inserted from the side portion of the main body of the image forming apparatus. Also, the bottom surface 41 of the paper tray 11 disposed on the upper side is set lower than the upper end 42 of the second paper feed roller 14 which feeds out the sheets of paper from the lower-side paper tray 12.

Figure 3:
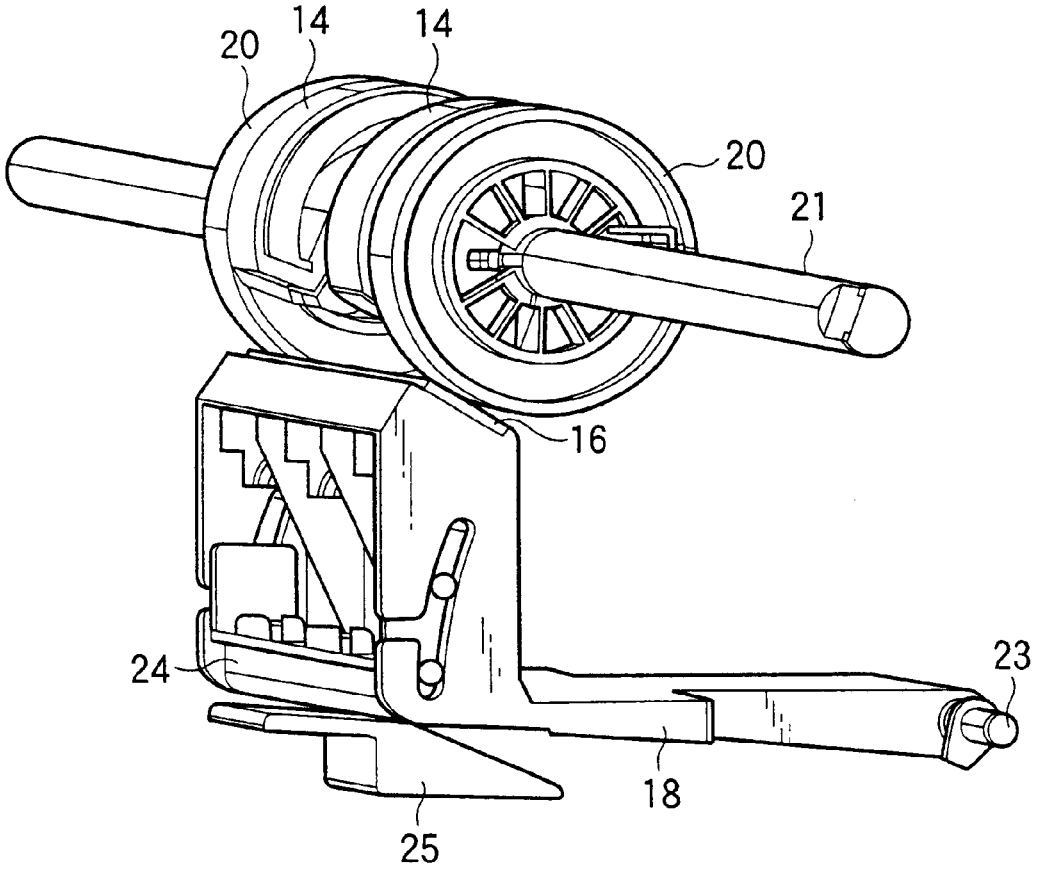
FIG. 3 is a schematically perspective view of a paper feed roller, a handling member and a holder for holding the same respectively used in the paper feeding apparatus shown in FIG. 2.

The paper feed roller 14, as shown in FIG. 3 or 4, is formed as a semilunar-shaped roller having a peripheral surface with a portion thereof cut away; and, when the paper feed roller 14 is driven or rotated, the peripheral surface thereof is contacted with the upper surfaces of the sheets of paper 27 stored within the paper tray 12 to thereby feed out the sheets of paper 27 sequentially one by one from the paper tray. Also, on the same shaft 21 of the paper feed roller 14, there is supported a core roller 20 in such a manner that it can be rotated freely. This core roller 20 is always contacted with a handling member 16 and, when the sheets of paper 27 fed out by the paper feed roller 14 are two or more sheets of paper 27 which are superimposed on top of each other, the core roller 20 separates the lower-side paper from the upper-side paper to thereby prevent the same from moving together with the upper-side paper.

Figure 4A:
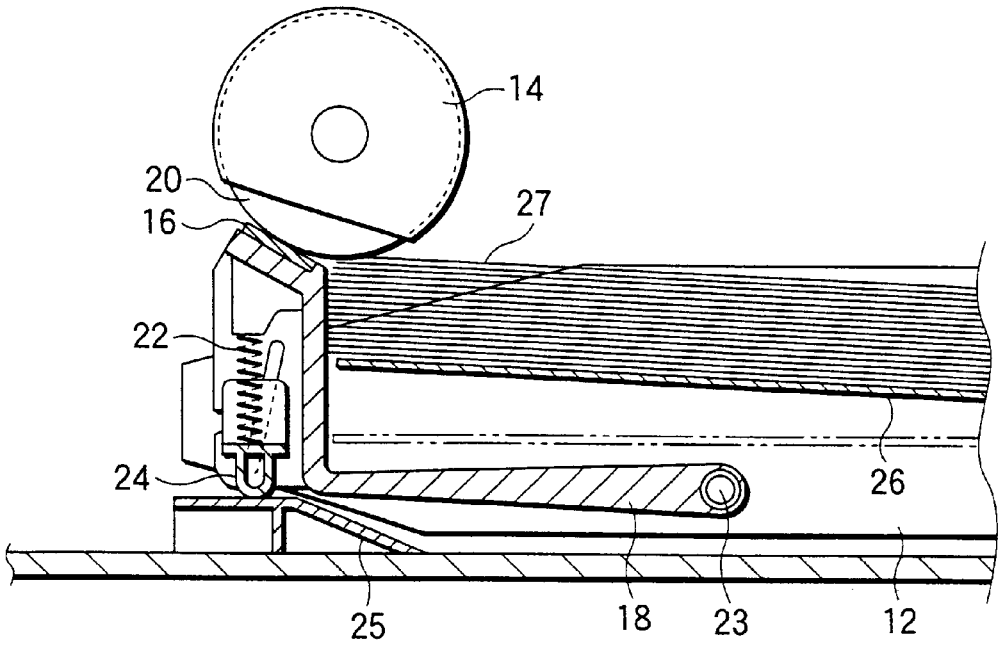
FIGS. 4A and 4B is section views of the paper feeding apparatus shown in FIG. 2, showing the operation of the holder when pulling out the paper tray.

The first paper feed roller 13 and second paper feed roller 14 are respectively disposed upwardly of the end portion of the upper-side paper tray 11 or lower-side paper tray 12 and, as shown in FIG. 4A, they are supported at a position where the sheets of paper stored in the paper trays can be contacted the first and second paper feed rollers 13 and 13. And, the upper-side paper tray 11 is disposed laterally of and adjacently to the second paper feed roller 14, while the height of the portion of the paper tray 11 positioned adjacently to the second paper feed roller 14 is set smaller than the diameter of the second paper feed roller 14. Also, the first paper feed roller 13, which feeds out the sheets of papers from the upper-side paper tray 11, is disposed in the rear of and obliquely upwardly of the second paper feed roller 14 with respect to the paper feed-out direction (in FIG. 2, the direction of an arrow mark B).

The first paper feed roller 13 and second paper feed roller 14 are disposed as near as possible to each other to thereby be able to reduce the area that is occupied by the paper feeding apparatus; and, the centers of the two paper feed rollers 13 and 14 are set at positions which are distant from each other in the horizontal direction or in the vertical direction by a distance equal to or larger than R1 or R2 and equal to or smaller than (R1+R2), where R1 and R2 express the radii of the paper feed rollers 13 and 14 respectively. By arranging the two paper feed rollers 13 and 14 in this manner, the horizontal and vertical dimensions that are occupied by the paper feeding apparatus can be both reduced, which makes it possible to realize the reasonable arrangement of the paper feeding apparatus 9.

And, the sheets of paper, which are to be fed out from the upper-side paper tray 11 by the first paper feed roller 13 disposed at the above-mentioned position, are passed through between the first and second paper feed rollers 13 and 14 and are then fed into the registration roller 10 disposed in the deliverable range of the first paper feed roller 13, that is, in the range of the other remaining peripheral surface length than the cut-away portion of the peripheral surface. Also, the sheets of papers, which are to be fed out from the lower-side paper tray 12 by the second paper feed roller 14, are also fed into the registration roller 10 as the second paper feed roller 14 is driven. That is, by arranging the first and second paper feed rollers 13 and 14 adjacently to each other and obliquely in the vertical direction with respect to each other in the above-mentioned manner, the sheets of paper to be fed out from both of the paper trays 11, 12 can be guided to the common registration roller 10 without providing another delivery roller in the area ranging from the paper feed rollers 13, 14 to the registration roller 10, which makes it possible to simplify the structure of the paper delivery passage.

On the other hand, the handling members 15, 16 respectively to be contacted with the paper feed rollers are formed of material having large friction with respect to the paper; and, therefore, when two or more sheets of paper are superimposed on top of each other, the handling members 15, 16 prevent the lower-side paper from moving together with the upper-side paper due to their larger frictional forces with respect to the paper than the frictional forces between the upper- and lower-side sheets of paper to there by allow only the upper-side paper to be delivered. These handling members 15, 16 are respectively supported on the holders 17, 18 which are rotatably mounted on the paper trays 11, 12 respectively, while the handling members 15, 16 are respectively energized by elastic members such as springs so as to be contacted with the paper feed rollers 13, 14. Also, the rotary shaft 23 of the holder 18 is disposed on the extension of the tangent of the portion of the handling member 16 where the handling member 16 is contacted with the paper feed roller 14. Due to this, the frictional force between the paper feed roller 14 and handling member 16 does not provide a couple with respect to the holder 18, which can prevent a possibility that the holder 18 can be vibrated to thereby produce a strange sound.

There is provided a mechanism which, when the paper tray 12 is pulled out for the purpose of replenishment of the paper, moves and retreats together the holder 18 mounted on the lower-side paper tray 12 and the handling member 16 supported on the holder 18 to thereby be able to prevent them from interfering with the second paper feed roller 14.

And, the present mechanism is structured in the following manner.

That is, as shown in FIG. 4A, the holder 18 rotatably supported on the paper tray 12 is energized by a spring 22 interposed between itself and an operation member 24 which can be contacted with the apparatus main body side and, due to such energizing force, the handling member 16 is contacted with the paper feed roller 14. And, the operation member 24, when the paper tray 12 is mounted into the apparatus main body, is contacted with a guide 25 mounted in the apparatus main body and is thereby guided to a position where it can push the holder 18 upwardly. Also, when removing the paper tray 12 from the apparatus main body, as shown in FIG. 4B, the operation member 24 is guided so as to move down rapidly along the inclined surface of the guide 25 and, in linking with this, the portion of the holder 18 that is supporting the handling member 16 is also moved down.

Due to this, in case where the paper tray 12 is moved in the pull-out direction, the holder 19 is rotated immediately and thus the handling member 16 is moved down to retreat from the paper feed roller 14. Therefore, the paper tray 12 can be pulled out smoothly in such a manner that the handling member 16 does not interfere with the paper feed roller 14.

Figure 4B:
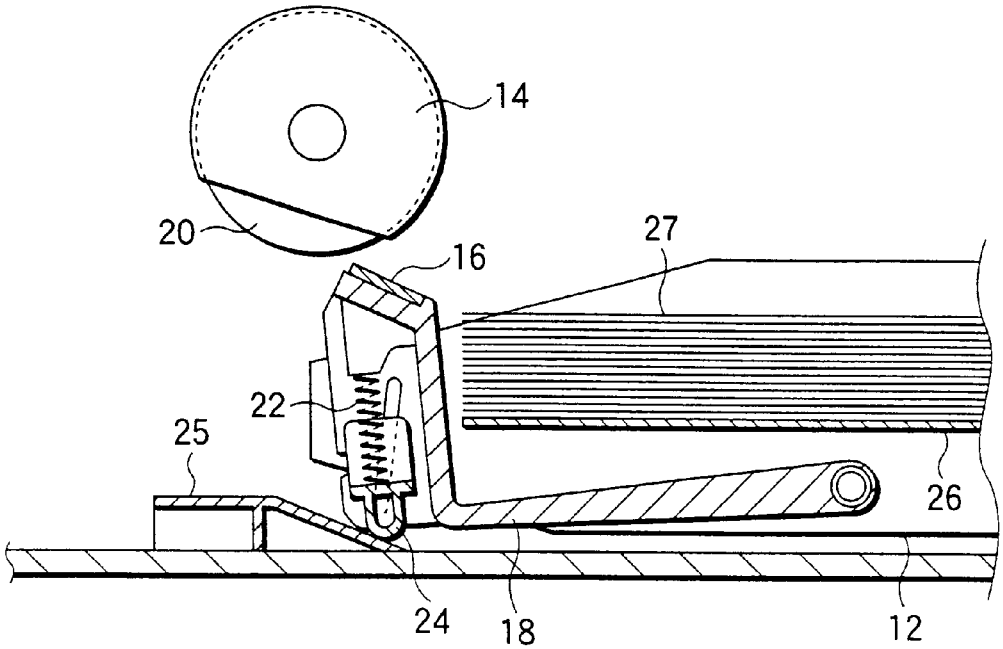

Also, while the paper tray 12 is mounted within the apparatus main body, as shown in FIG. 4B, a paper carrier plate 26 is pulled upwardly and the upper surface of the pacer 27 stored within the paper tray 12; and, as the paper tray 12 is pulled out from the apparatus main body, the paper carrier plate 26 is moved down as shown in FIG. 4B. And, when the paper tray 12 is pulled out from the apparatus main body, the paper carrier plate 26 is situated on the bottom portion of the paper tray 12, which can facilitate the replenishment of the paper.

Figure 5:
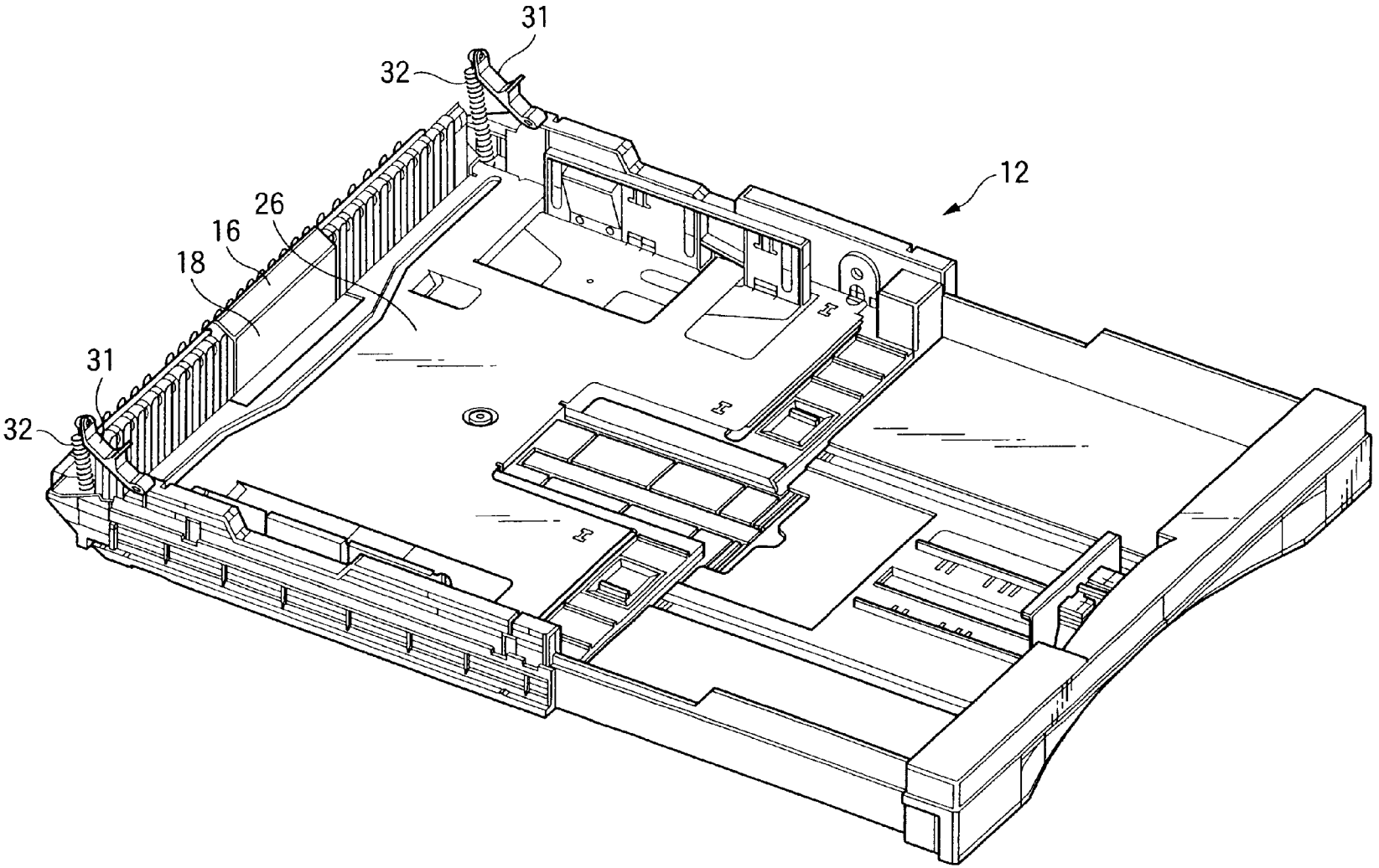
FIG. 5 is a perspective view of the paper tray used in the paper feeding apparatus shown in FIG. 2.

A mechanism for pulling up the paper carrier plate 26 in this manner is structured in the following manner:

That is, as shown in FIG. 5, the paper tray 12 includes two arm-shaped pull-up members 31 respectively mounted in the vicinity of the deep-side leading ends of the paper tray 12 in such a manner that one-side ends thereof can be rotated, and two springs 32 respectively having their respective two ends connected to the other-side ends of the pull-up members 31 and to the paper carrier plate 26. And, when mounting the paper tray 12 into the apparatus main body, the pull-up members 31 are respectively pulled upwardly by their associated guide members 33 respectively fixed to the apparatus main body side, thereby being able to energize the paper carrier plate 26.

Figure 6:
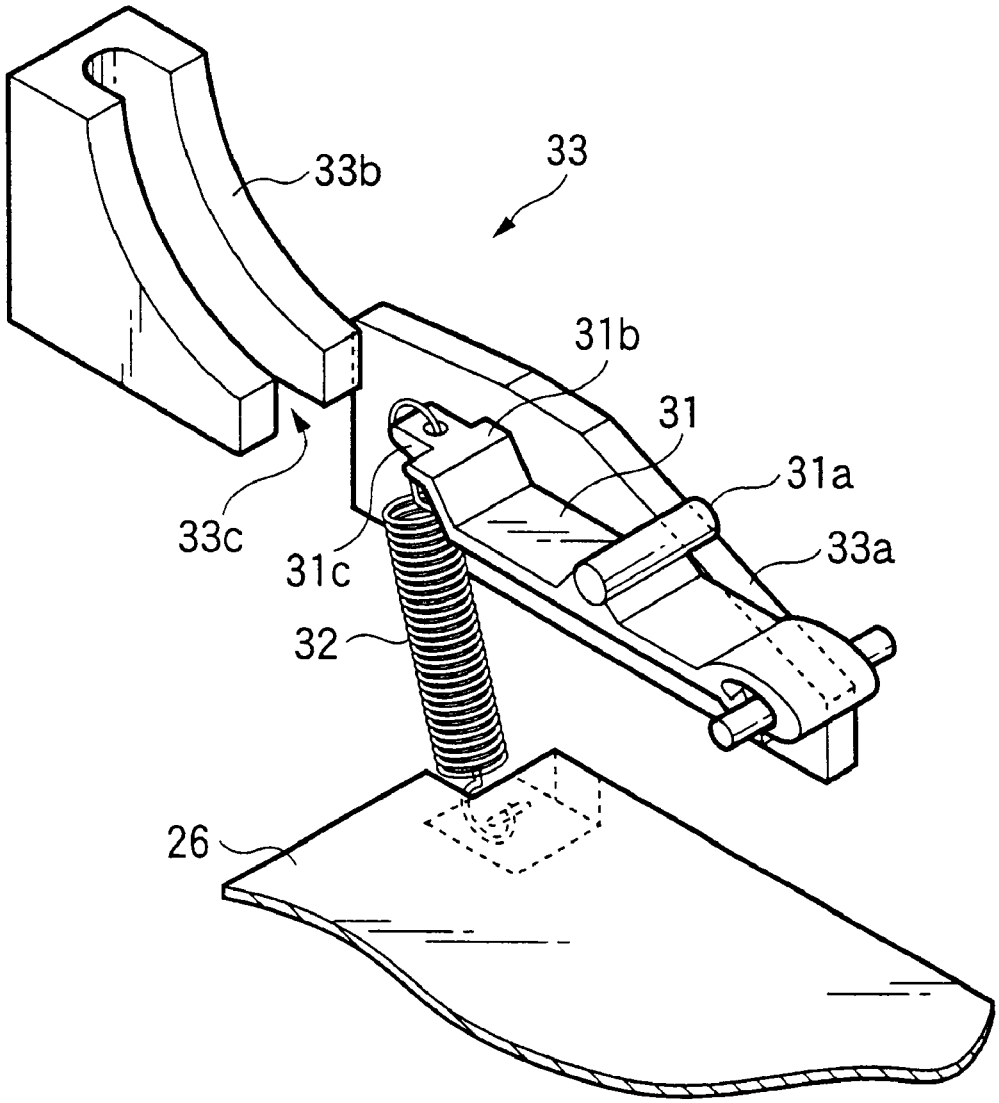
FIG. 6 is a schematically perspective view of a pull-up member and a guide member used in the paper feeding apparatus shown in FIG. 2.

Each of the pull-up members 31, as shown in FIGS. 5 and 6, is mounted in such a manner that one end thereof can be rotated; and, each pull-up member 31 includes in the vicinity of the central portion thereof a first engagement portion 31*a* which projects laterally. Also, in the leading end portion of the pull-up member 31, there is formed a second engagement portion 31*b*, while the spring 32 is connected to the portion 31*c* of the pull-up member 31 that projects further than the second engagement portion 31*b*.

On the other hand, the guide member 33 includes a first guide surface 33*a* at a position thereof which is opposed to the paper tray side portion of the apparatus main body side, and a second guide surface 33*b* formed in the portion of the guide member 33 that provides the upper front portion thereof when the paper tray 12 is mounted. The guide members 33, when mounting the paper tray 12, are respectively contacted with the first and second engagement portions 31*a*, 31*b* of their associated pull-up members 31 to thereby guide or pull up the respective leading end portions 31*c* of the pull-up members 31 to which the springs 32 are connected.

Next, description will be given below of the operations of the pull-up members 31 and the functions of the guide members 33 when mounting the paper tray 12 with reference to FIGS. 7A to 7C.

Figure 7A:
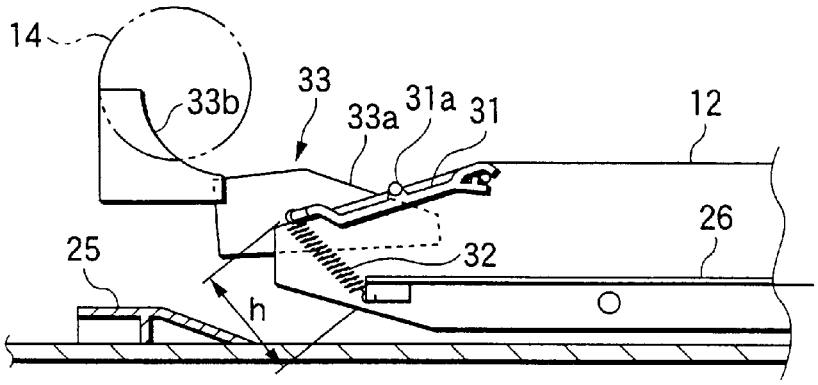
FIGS. 7A to 7C are schematic views of the paper tray used in the paper feeding apparatus shown in FIG. 2, showing the functions of the pull-up member and guide member and the operation of the paper carrier plate when mounting the paper tray.

When the paper tray 12 is pulled out from the apparatus main body, as shown in FIG. 7A, the leading end portions of the pull-up members 31 are respectively held in the lowered position, while the paper carrier plate 26 is moved down to the lower-most position of the bottom portion of the paper tray 12. And, as the paper tray 12 is inserted for mounting, the first engagement portions 31*a* of the pull-up members 31 are respectively contacted with the first guide surfaces 33*a* of the guide members 33, whereby the pull-up members 31 are guided upwardly with the inserting operation of the form tray 12.

At the then time, the first engagement portions 31*a* are projected laterally and are thereby contacted with the first guide surfaces 33*a*, so that the upwardly pulling forces of the guide members 33 are transmitted to the pull-up members 31 to thereby apply torsional forces to the pull-up members 31; and, although the torsional forces are not able to provide large forces, they are enough to guide the pull-up members 31 at an initial stage for pulling up the paper carrier plate 26.

Figure 7B:
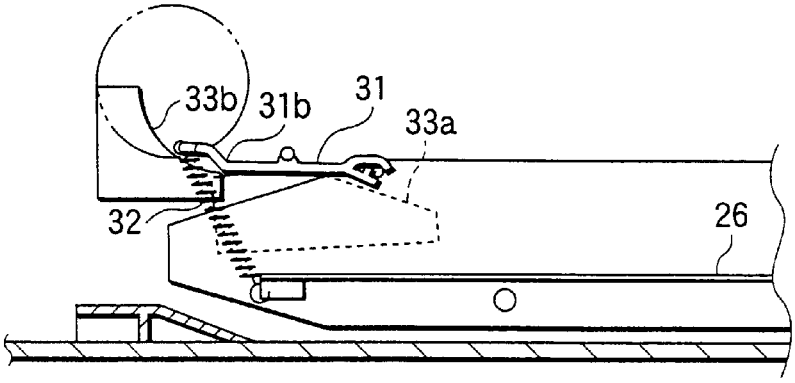

In case where the pull-up members 31 are slided along the first guide surfaces 33*a* of the guide members 33 and, as shown in FIG. 7B they reach the highest portions of the first guide surfaces 33*a*, the second engagement portions 31*b* formed in the vicinity of the leading end portions of the pull-up members 31 are respectively contacted with the second guide surfaces 33*b* of the guide members 33. And, in case where the paper tray 12 is inserted further, as shown in FIG. 7C, the second engagement portions 31*b* are respectively guided upwardly along the second guide surfaces 33*b*, so that the paper carrier plate 26 is pulled up through the springs 32. As a result of this, the upper surface of the paper on the paper carrier plate 26 is contacted with the paper feed roller 14, thereby providing a state in which the sheets of paper 27 can be fed out sequentially one by one due to the rotation of the paper feed roller 14.

In this case, the portions 31*c* of the pull-up members 31 connected to the springs 32, as shown in FIG. 6, respectively pass through within their associated slits 33*c* formed between the two divided portions of the second guide surfaces 33*b*, while the second engagement portions 31*b* are respectively contacted in the two end portions thereof with the second guide surfaces 33*b*. Therefore, the pull-up members 31 can be guided upwardly with a strong force without applying a torsional force to the pull-up members 31. Thanks to this, even in case where a large number of sheets of paper are present on the paper carrier plate 26, the paper carrier plate 26 can be pulled up and thus the sheets of paper 27 can be contacted with the paper feed roller 14.

As described above, since the pull-up members 31 are guided and pulled upwardly by the guide members 33 as the paper tray 12 is mounted, the sheets of paper 27 on the form carrier plate 26 can be contacted with the paper feed roller 14. Also, because each of the pull-up members 31 includes two engagement portions and the engagement portions are guided by the two guide surfaces 33*a*, 33*b* of each of the guide members 33 step by step, the guide members 33 can be arranged so as not to interfere with the paper tray 12 and also can be operated in a large range.

And, since the pull-up members 31 are guided in two stages, the free length h of each of the springs 32 can be shortened to thereby reduce the height of each guide member 33 and thus minimize the height of the area to be occupied by the paper feeding apparatus. That is, as shown in FIG. 7A, the leading end portion of each pull-up member 31 can be lowered down to a low position and, therefore, even in case where the free length h of each spring 32 is set short, there is eliminated a possibility that the paper carrier plate 26 can be floated within the paper tray 12 when the paper tray 12 is pulled out from the image forming apparatus main body. Also, as shown in FIG. 7C, the length H of each spring 32 when the paper tray 12 is mounted and the upper surface of the paper is contacted with the paper feed roller 14 can be shortened, which makes it possible to lower the height of each guide member 33.

By the way, the length H of the spring 32 when the upper surface of the form is contacted with the paper feed roller 14, in case where a large number of sheets of paper are carried or piled up on the paper carrier plate 26, provides as follows:

$$H=h+\alpha+\beta$$

In case where only one or two sheets of paper are present on the paper carrier plate 26, the length H provides as follows:

$$H=h+\beta$$

Figure 7C:
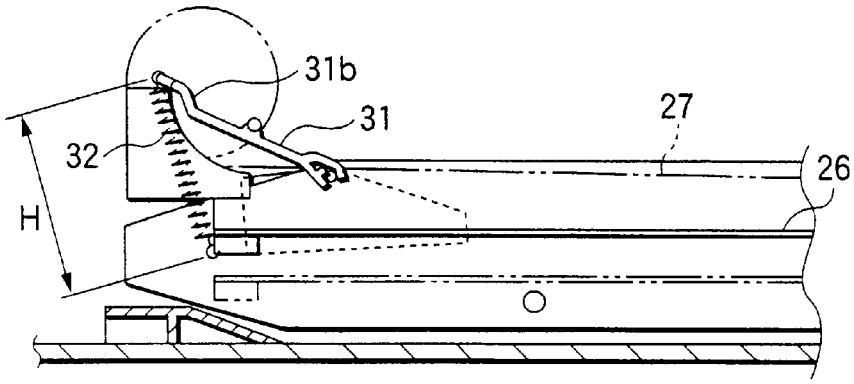
Figure 8A:
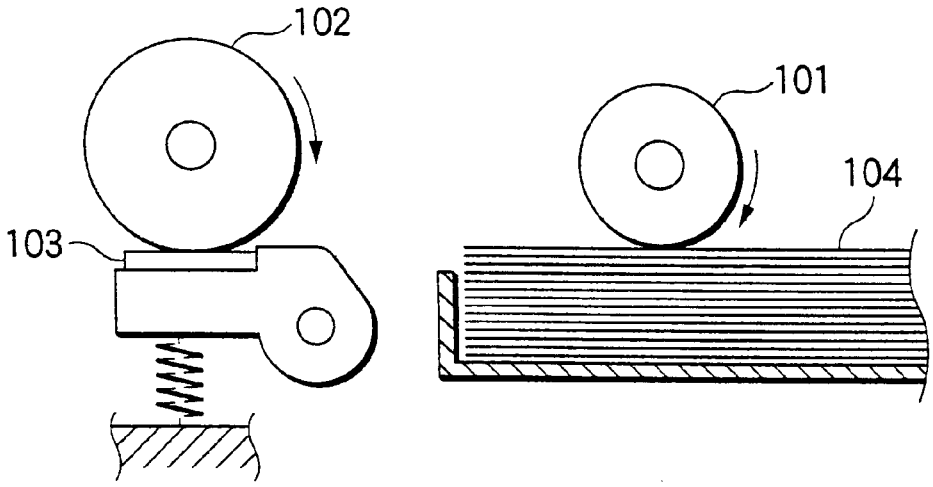
PRIOR ART FIG.8A
FIGS. 8A to 8B are schematic views of the structures of conventional paper feed rollers and handling members.
Figure 8B:
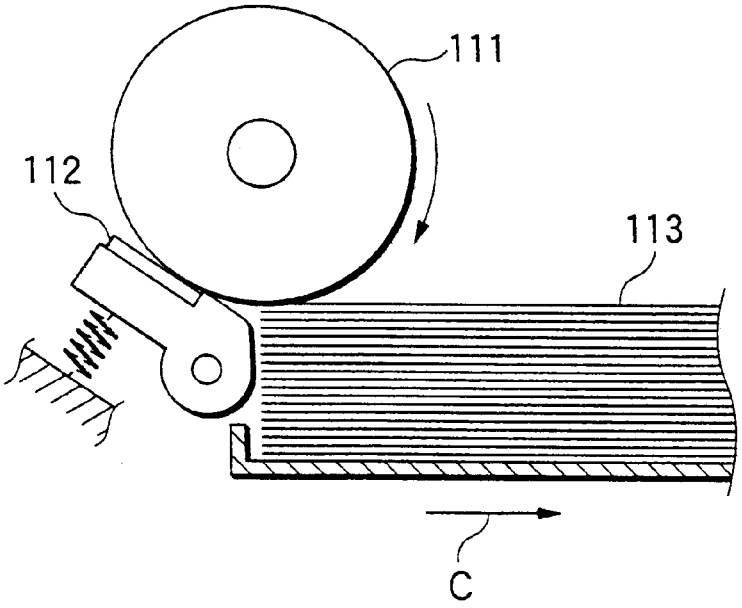
PRIOR ART FIG.8B
Figure 9:
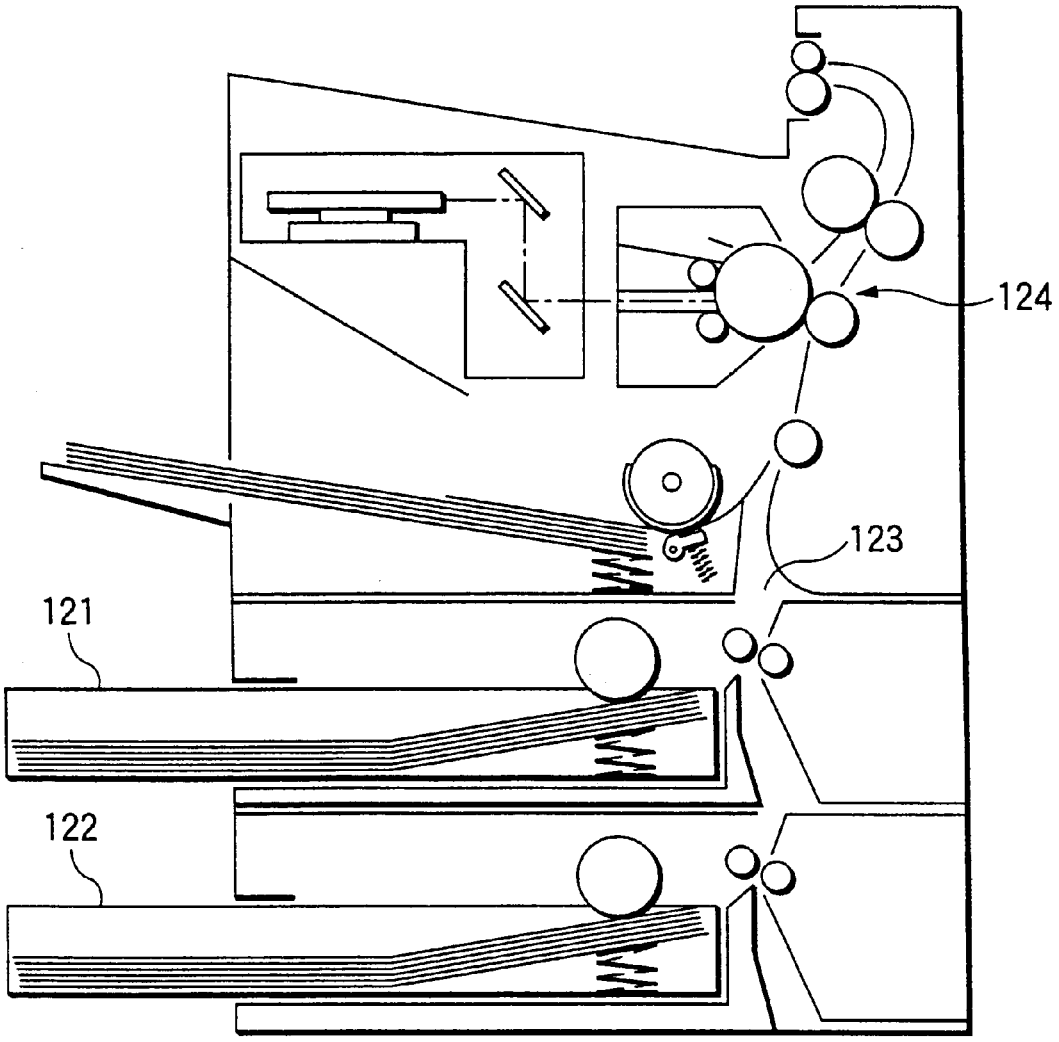
FIG.9 PRIOR ART
FIG. 9 is a schematic view of an example of a conventional image forming apparatus.

Here, $\alpha$ expresses the amount of extension of the spring for applying a force which is used to bring the paper into pressure contact with the paper feed roller, and $\beta$ expresses the amount of extension of the spring caused by supporting a large number of sheets of paper piled up on the paper carrier plate, in the embodiment shown in FIGS. 7A to 7C, approx. 26 mm.

As has been described heretofore, in the paper feeding apparatus and image forming apparatus according to the invention, the two paper feed rollers respectively used to feed the sheets of paper from the two different paper trays are disposed so as to be adjacent to each other, one of them is positioned backwardly of and obliquely upwardly of the other, and the paper feed rollers and paper trays or paper delivery passage rollers are uniquely structured, whereby the area to be occupied by the paper feeding apparatus can be reduced. And, the structure of the paper delivery passage can be simplified, which makes it possible to reduce the manufacturing cost of the paper feeding apparatus.

Also, the paper trays can be removed from the main body of the image forming apparatus by pulling the paper trays from the apparatus main body and the handling members to be contacted with the paper feed rollers can be retreated as the paper trays are pulled out from the apparatus main body, which makes it possible to realize the smooth mounting and removing operations of the paper trays with a simple structure.

Further, when mounting the paper tray, the paper carrier plate included in the paper tray can be pulled upwardly by the pull-up members mounted on the paper tray and the guide members mounted on the apparatus main body, thereby being able to provide a state in which the paper can be fed with a simple mechanism. Also, since each guide member includes two guide surfaces and the two engagement portions of each pull-up member are respectively engaged with the two guide surfaces step by step, the paper carrier plate capable of piling up a large number of sheets of paper thereon can be pulled up positively with a simple structure and the paper can be contacted with the paper feed roller.

What is claimed is:

1. A paper feeding apparatus comprising:

an upper paper tray for piling up and storing first sheets of paper;

a lower paper tray disposed below the upper paper tray, the lower paper tray for piling up and storing second sheets of paper;

a first paper feed roller contactable with the first sheets of paper in the upper paper tray, the first paper feed roller for feeding out the first sheets of paper one by one;

a second paper feed roller contactable with the second sheets of paper in the lower paper tray, the second paper feed roller for feeding out the second sheets of paper one by one;

a paper delivery roller for receiving and delivering both of the first and second sheets of paper fed out from the upper and lower paper trays, respectively; and a holder mounted on the lower paper tray and having an end terminated with a handling member, wherein the end of the holder is oriented to a downstream side of a paper-feed-out direction at which the second paper feed roller is contacted with the second sheets of paper stored in the lower paper tray, wherein the handling member is contactable with a peripheral surface of the second paper feed roller, wherein the lower paper tray is removable from a main body by pulling out the lower paper tray in a direction opposite to the paper-feed-out direction, and wherein the first paper feed roller is disposed backward and obliquely upward of the second paper feed roller with respect to the paper feed-out direction to feed out the sheets of paper.

2. The paper feeding apparatus as set forth in claim 1, wherein one of the first and second paper feed rollers has a peripheral surface cut away in part, the peripheral surface feeding the sheets of paper to the paper delivery roller while the one of the first and second paper feed rollers rotates once to thereby allow the peripheral surface to feed the sheets of paper.

3. The paper feeding apparatus as set forth in claim 2, wherein the first or second paper feed roller has a semicircular shape.

4. The paper feeding apparatus of claim 1, wherein the handling member is configured to retreat from the surface of the second paper feed roller when the lower paper tray is pulled away from the second paper feed roller in the direction opposite to the paper-feed-out direction.

5. A paper feeding apparatus comprising:

an upper paper tray for piling up and storing first sheets of paper;

a lower paper tray disposed below the upper paper tray, the lower paper tray for piling up and storing second sheets of paper;

a first paper feed roller contactable with the first sheets of paper in the upper paper tray, the first paper feed roller for feeding out the first sheets of paper one by one;

a second paper feed roller contactable with the second sheets of paper in the lower paper tray, the second paper feed roller for feeding out the second sheets of paper one by one; and a holder mounted on the lower paper tray and having an end terminated with a handling member, wherein the upper paper tray is disposed backwardly of and adjacently to the second paper feed roller with respect to a paper feed-out direction to feed out the second sheets of paper, the first paper feed roller is disposed obliquely backward of the second paper feed roller with respect to the paper feed-out direction, the first sheets of paper to be fed out by the first paper feed roller are allowed to pass through between the first and second paper feed rollers, centers of the first and second paper feed rollers are set at positions distant from each other in the horizontal direction with a distance equal to or more than R1 or R2 and equal to or less than (R1+R2), where R1 and R2 respectively express radii of the first and second paper feed rollers, wherein the end of the holder is oriented to a downstream side of the paper-feed-out direction at which the second paper feed roller is contacted with the second sheets of paper stored in the lower paper tray, wherein the handling member is contactable with a peripheral surface of the second paper feed roller, and wherein the lower paper tray is removable from a main body by pulling out the lower paper tray in a direction opposite to the paper-feed-out direction.

6. The paper feeding apparatus of claim 5, wherein the handling member is configured to retreat from the surface of the second paper feed roller when the lower paper tray is pulled away from the second paper feed roller in the direction opposite to the paper-feed-out direction.

7. A paper feeding apparatus comprising:

an upper paper tray for piling up and storing first sheets of paper, the upper paper tray having a bottom surface;

a lower paper tray disposed below the upper paper tray, the lower paper tray for piling up and storing second sheets of paper;

a first paper feed roller contactable with the first sheets of paper in the upper paper tray, the first paper feed roller for feeding out the first sheets of paper one by one; and a second paper feed roller contactable with the second sheets of paper in the lower paper tray, the second paper feed roller having an upper end, and the second paper feed roller for feeding out the second sheets of paper one by one; and holder mounted on the lower paper tray and having an end terminated with a handling member, wherein the bottom surface of the upper paper tray is set lower than the upper end of the second paper feed roller, wherein the first paper feed roller is disposed backward of, obliquely upward of, and adjacently to the second paper feed roller with respect to a paper feed-out direction to feed out the second sheets of paper, and centers of the first and second paper feed rollers are set at positions distant from each other in the horizontal direction with a distance equal to or more than R1 or R2 and equal to or less than (R1+R2), where R1 and R2 respectively express radii of the first and second paper feed rollers, wherein the end of the holder is oriented to a downstream side of the paper-feed-out direction at which the second paper feed roller is contacted with the second sheets of paper stored in the lower paper tray, wherein the handling member is contactable with a peripheral surface of the second paper feed roller, and wherein the lower paper tray is removable from a main body by pulling out the lower paper tray in a direction opposite to the paper-feed-out direction.

8. The paper feeding apparatus of claim 7, wherein the handling member is configured to retreat from the surface of the second paper feed roller when the lower paper tray is pulled away from the second paper feed roller in the direction opposite to the paper-feed-out direction.

9. A paper feeding apparatus comprising:

an upper paper tray for piling up and storing first sheets of paper;

a lower paper tray disposed below the upper paper tray, the lower paper tray for piling up and storing second sheets of paper;

a first paper feed roller contactable with the first sheets of paper in the upper paper tray, the first paper feed roller for feeding out the first sheets of paper one by one;

a second paper feed roller contactable with the second sheets of paper in the lower paper tray, the second paper feed roller for feeding out the second sheets of paper one by one; and a holder mounted on the lower paper tray and having an end terminated with a handling member, wherein the handling member is disposed on a downstream side of a paper-feed-out direction at which the second paper feed roller is contacted with the second sheets of paper stored in the lower paper tray, the handling member is pressed against the second paper feed roller, wherein the lower paper tray is removable from a main body by pulling out the lower paper tray in a direction opposite to the paper-feed-out direction, wherein the first paper feed roller is disposed backwardly of, obliquely upwardly of, and adjacently to the second paper feed roller with respect to the paper feed-out direction to feed out the second sheets of paper, and centers of the first and second paper feed rollers are set at positions distant from each other in the vertical direction with a distance equal to or more than R1 or R2 and equal to or less than (R1+R2), where R1 and R2 respectively express radii of the first and second paper feed rollers.

10. The paper feeding apparatus of claim 9, wherein the handling member retreats from a peripheral surface of the second paper feed roller when the lower paper tray is pulled away from the second paper feed roller in the direction opposite to the paper-feed-out direction.

11. A paper feeding apparatus comprising:

an upper paper tray for piling up and storing first sheets of paper;

a lower paper tray disposed below the upper paper tray, the lower paper tray for piling up and storing second sheets of paper;

a first paper feed roller contactable with the first sheets of paper in the upper paper tray, the first paper feed roller for feeding out the first sheets of paper one by one;

a second paper feed roller contactable with the second sheets of paper in the lower paper tray, the second paper feed roller for feeding out the second sheets of paper one by one; and a holder mounted on the lower paper tray and having an end terminated with a handling member, wherein the lower paper tray is removable from a main body by pulling out the lower paper tray in a direction opposite to the paper-feed-out direction, wherein the handling member retreats from a peripheral surface of the second paper feed roller when the lower paper tray is pulled away from the second paper feed roller in the direction opposite to the paper-feed-out direction, wherein the first paper feed roller is disposed backward of, obliquely upward of, and adjacently to the second paper feed roller with respect to the paper feed-out direction to feed out the second sheets of paper, and the upper paper tray is disposed backwardly of and adjacently to the second paper feed roller with respect to the paper feed-out direction, while the height of the upper paper tray is set smaller than a diameter of the second paper feed roller.

12. The paper feeding apparatus of claim 11, wherein the handling member is disposed on a downstream side of a paper-feed-out direction at which the second paper feed roller is contacted with the second sheets of paper stored in the lower paper tray, the handling member is pressed against the second paper feed roller.

13. An image forming apparatus comprising:

an image forming unit for forming an image on a sheet of paper in accordance with a digital signal, or for transferring an image formed on an image carrier element onto a sheet of paper;

a paper feeding apparatus for storing sheets of paper, the paper feeding apparatus for feeding out the sheets of paper one by one therefrom; and a registration roller for delivering the sheets of paper fed out from the paper feeding apparatus at a given timing to a position opposed to the image forming unit, wherein the paper feeding apparatus includes:

an upper paper tray for piling up and storing first sheets of paper, the upper paper tray having a bottom surface;

a lower paper tray disposed below the upper paper tray, the lower paper tray for piling up and storing second sheets of paper;

a first paper feed roller contactable with the first sheets of paper in the upper paper tray, the first paper feed roller for feeding out the first sheets of paper one by one; and a second paper feed roller contactable with the second sheets of paper in the lower paper tray, the second paper feed roller having an upper end, and the second paper feed roller for feeding out the second sheets of paper one by one; and a holder mounted on the lower paper tray and having an end terminated with a handling member, wherein the end of the holder is oriented to a downstream side of a paper-feed-out direction at which the second paper feed roller is contacted with the second sheets of paper stored in the lower paper tray, wherein the handling member is contactable with a peripheral surface of the second paper feed roller, wherein the lower paper tray is removable from a main body by pulling out the lower paper tray in a direction opposite to the paper-feed-out direction, wherein the bottom surface of the upper paper tray is set lower than the upper end of the second paper feed roller, wherein the first and second paper feed rollers feed the first and second sheets of paper into the registration roller, respectively.

14. The paper feeding apparatus of claim 13, wherein the handling member is configured to retreat from the surface of the second paper feed roller when the lower paper tray is pulled away from the second paper feed roller in the direction opposite to the paper-feed-out direction.

15. An image forming apparatus, comprising:

an image forming unit for forming an image on a sheet of paper in accordance with a digital signal, or for transferring an image formed on an image carrier element onto a sheet of paper;

a paper feeding apparatus for storing sheets of paper, the paper feeding apparatus for feeding out the sheets of paper one by one therefrom; and a paper delivery unit for delivering the sheets of paper fed out from the paper feeding apparatus to a position opposed to the image forming unit, wherein the paper feeding apparatus comprising:

an upper paper tray for piling up and storing first sheets of paper;

a lower paper tray disposed below the upper paper tray, the lower paper tray for piling up and storing second sheets of paper;

a first paper feed roller contactable, with the first sheets of paper in the upper paper tray, the first paper feed roller for feeding out the first sheets of paper one by one; and a second paper feed roller contactable with the second sheets of paper in the lower paper tray, the second paper feed roller for feeding out the second sheets of paper one by one; and a holder mounted on the lower paper tray and having an end terminated with a handling member, wherein the end of the holder is oriented to a downstream side of a paper-feed-out direction at which the second paper feed roller is contacted with the second sheets of paper stored in the lower paper tray, wherein the handling member is contactable with a peripheral surface of the second paper feed roller, wherein the lower paper tray is removable from a main body by pulling out the lower paper tray in a direction opposite to the paper-feed-out direction, wherein the upper paper tray is disposed backwardly of and adjacently to the second paper feed roller with respect to the paper feed-out direction to feed out the second sheets of paper, the first paper feed roller is disposed obliquely backward of the second paper feed roller with respect to the paper feed-out direction, centers of the first and second paper feed rollers are set at positions distant from each other in the horizontal direction with a distance equal to or more than R1 or R2 and equal to or less than (R1+R2), where R1 and R2 respectively express radii of the first and second paper feed rollers, and the first sheets of paper to be fed out by the first paper feed roller are allowed to pass through between the first and second paper feed rollers.

16. The paper feeding apparatus of claim 15, wherein the handling member is configured to retreat from the surface of the second paper feed roller when the lower paper tray is pulled away from the second paper feed roller in the direction opposite to the paper-feed-out direction.

17. A paper feeding apparatus comprising:

an upper paper tray for piling up and storing first sheets of paper, the upper paper tray having a bottom surface;

a lower paper tray disposed below the upper paper tray, the lower paper tray for piling up and storing second sheets of paper;

a first paper feed roller contactable with the first sheets of paper in the upper paper tray, the first paper feed roller for feeding out the first sheets of paper one by one;

a second paper feed roller contactable with the second sheets of paper in the lower paper tray, the second paper feed roller having an upper end, and the second paper feed roller for feeding out the second sheets of paper one by one; and a holder mounted on the lower paper tray and having an end terminated with a handling member, wherein the handling member is disposed on a downstream side of a paper-feed-out direction at which the second paper feed roller is contacted with the second sheets of paper stored in the lower paper tray, the handling member is pressed against the second paper feed roller, wherein the lower paper tray is removable from a main body by pulling out the lower paper tray in a direction opposite to the paper-feed-out direction, wherein the first paper feed roller is backwardly of, obliquely upwardly of, and adjacently to the second paper feed roller with respect to the paper feed-out direction to feed out the second sheets of paper, and the upper paper tray is disposed backwardly of and adjacently to the second paper feed roller with respect to the paper feed-out direction, while the bottom surface of the upper paper tray is set lower than the upper end of the second paper feed roller.

18. The paper feeding apparatus of claim 17, wherein the handling member retreats from a peripheral surface of the second paper feed roller when the lower paper tray is pulled away from the second paper feed roller in the direction opposite to the paper-feed-out direction.

* * * * *